US005487337A

United States Patent [19]

Uland

[11] Patent Number: 5,487,337

[45] Date of Patent: Jan. 30, 1996

[54] METHOD AND APPARATUS FOR PRINTING LINERLESS MEDIA HAVING AN ADHESIVE BACKING

[75] Inventor: David M. Uland, Mecklenburg County, N.C.

[73] Assignee: DataSouth Computer Corporation, Charlotte, N.C.

[21] Appl. No.: 288,958

[22] Filed: Aug. 11, 1994

Related U.S. Application Data

[63] Continuation-in-part of Ser. No. 243,198, May 16, 1994.

[51] Int. Cl.[6] ..... B41F 1/08

[52] U.S. Cl. ..... 101/288; 156/384

[58] Field of Search ..... 101/228, 288, 101/92; 156/564, 566, 567, 384, 386, 387

[56] References Cited

U.S. PATENT DOCUMENTS

| | | | |
|---|---|---|---|
| 2,326,436 | 8/1943 | Caldwell . | |
| 3,284,270 | 11/1966 | Noll et al. . | |
| 4,073,234 | 2/1978 | Sato . | |
| 4,358,333 | 11/1982 | Holland-Letz | 101/288 |
| 4,384,525 | 5/1983 | Sato et al. . | |
| 4,826,558 | 5/1989 | Wada et al. | 156/384 |
| 5,069,564 | 12/1991 | Kako et al. . | |
| 5,083,979 | 1/1992 | Burt | 462/3 |
| 5,111,216 | 5/1992 | Richardson et al. | 346/76 PH |
| 5,188,029 | 2/1993 | Sugimoto et al. | 101/288 |
| 5,190,612 | 3/1993 | Orlandi . | |
| 5,267,800 | 12/1993 | Petteruti et al. | 400/88 |
| 5,295,753 | 3/1994 | Godo et al. | 400/612 |
| 5,417,783 | 5/1995 | Boreali et al. | 156/64 |

*Primary Examiner*—Ren Yan

*Attorney, Agent, or Firm*—Bell, Seltzer, Park & Gibson

[57] ABSTRACT

The method and apparatus for printing linerless media having an adhesive backing, such as a label strip, includes a platen roller rotatably mounted to a support frame for supporting and advancing the label strip and means, such as a stripping roller, for stripping or separating the printed label strip from the platen roller. Thus, a label strip can be fed from a wound roll between the platen roller and an aligned print head such that predetermined indicia are imprinted thereon. Upon further rotation of the platen roller, the leading edge of the label strip engages the stripping roller which acts to release any appreciable adherence between the adhesive backing of the label strip and the platen roller, and such that the printed labels may extend from and be readily withdrawn from the printing apparatus.

21 Claims, 2 Drawing Sheets

METHOD AND APPARATUS FOR PRINTING LINERLESS MEDIA HAVING AN ADHESIVE BACKING

RELATED APPLICATION

This application is a continuation-in-part of U.S. patent application Ser. No. 08/243,198 filed May 16, 1994, the contents of which are expressly incorporated in their entirety herein.

FIELD OF THE INVENTION

The present invention relates to printing devices and, more particularly, to devices for printing linerless media having an adhesive backing.

BACKGROUND OF THE INVENTION

Numerous labels and forms are printed each day for a variety of purposes. The printed labels may be attached to envelopes or other packages to indicate the source or destination of the envelope or package as well as any other handling information related to the particular package. For example, the U.S. Postal Service, Federal Express and other delivery services prepare individual labels for each letter or package to be delivered which indicate the addresses of both the source and the recipient, a tracking number and other relevant shipping information. Printed labels may also be applied to boxes, crates or other containers for purposes of inventory control and tracking. Such labels generally identify the type and quantity of goods in the container as well as the location of the container.

In order to print the large number of labels required, devices for rapidly printing large numbers of labels have been developed. These printing devices generally draw a continuous strip of labels from a wound roll and feed the labels past a print head such that predetermined information may be imprinted upon the individual labels. The operator may thereafter remove the printed labels and apply them to the corresponding packages.

Such printing devices include both stationary printing devices which are generally relatively large and portable printing devices which are relatively small so as to be carried by an operator in the field or through a warehouse. Such portable printers include not only the print head and means for entering data, such as a keypad, but also a wound roll of labels and the feed mechanism for drawing labels from the wound roll. Thus, labels may be printed on demand and applied to packages or containers in the field without the operator having to return to a stationary printing device in order to print the desired labels. For example, after counting the number of items in a particular container, an operator of a portable printing device may enter data representative of the type, quantity and location of the items, such as via a keypad, into the portable printer, print a label displaying such data and apply the label to the container.

The information to be imprinted on the labels is provided to the printing device from any one of several sources, including manual entry of the data via a keypad or downloading of data from a control computer. The information, regardless of its source, is imprinted upon the labels by a variety of methods including serial dot matrix printing, thermal printing, laser printing, impact matrix printing, ink jet printing, impact full form printing or other electrographic printing methods.

To further facilitate the rapid printing and processing of labels, labels have been specifically developed to be printed by such label printing devices. These labels, which are generally supplied in a wound roll, typically have an adhesive backing and are releasably supported by a carrier web or liner. In particular, a layer of a release agent, such as silicone, is generally disposed between the adhesive backing and the carrier web to permit removal of the labels from the carrier web.

In operation, the wound roll of labels and the supporting carrier web are rotatably supported by the printing device. The label strip is drawn from the roll and sequentially fed past a print head to imprint the desired information. The label strip is drawn from the wound roll and fed past the print head by a feed mechanism, such as one or more aligned rollers. Once printed, the labels are removed from the carrier web, such as by passing the label strip about a roller having a relatively small diameter, so as to permit application of the imprinted labels to a package. With respect to stationary printing devices, the remaining carrier web may thereafter be wound upon a take-up reel for subsequent disposal.

The carrier web remaining once the labels have been printed and removed is not reused, but is scrap which must be discarded. Even the disposal of the scrap carrier web is problematic, however, since the carrier web contains silicone which requires a relatively long time to degrade. Further, it is estimated that the cost of the carrier web amounts to 20% to 30% of the original cost of the wound roll of labels, thus, significantly increasing the material cost of the labels.

In addition, the carrier web contributes substantially to the overall size of the wound roll of labels. Since portable printing devices are relatively compact and may accordingly only accommodate a wound roll of labels of a predetermined size, the carrier web limits the number of labels which may be included within a portable printing device at any one time. Furthermore, the disposal of carrier web remaining after the labels have been removed is an even greater problem with respect to portable printing devices since such portable printers do not generally include a take-up reel for storing the remaining carrier web for subsequent disposal. Instead, the remaining carrier web must typically be periodically separated from the remainder of the wound roll of labels and disposed of or otherwise stored by the operator to prevent excessive amounts of the scrap carrier web from extending from and accumulating adjacent to the portable printer.

Accordingly, linerless labels have been developed which do not include a supporting carrier web. These labels have a primary substrate which is coated with a layer of adhesive on one side. Further, if these labels are formed in a strip which is to be wound in a roll, a layer of a release agent, such as silicone, is applied to a second side of the primary substrate, opposite the adhesive layer, so as to permit wound roll of labels to be unwound during printing.

However, conventional label printing machines, including conventional portable printing devices, are not adapted to process labels or strips of labels which are not supported by a carrier web. Correspondingly, the adhesive backed labels adhere to the feed mechanism of the printing device. Consequently, the printed labels may not be readily withdrawn from the printing device.

An apparatus for printing a linerless label strip having an adhesive backing which is not supported by a carrier web is disclosed in copending U.S. patent application Ser. No. 08/180,050 (hereinafter the "'050 application") to David M.

Uland filed on Jan. 11, 1994 and assigned to the assignee of the present application, the contents of which are incorporated herein by reference. The printing apparatus of the '050 application includes an endless belt for transporting the label strip between a print head and an underlying platen and for permitting withdrawal of the label strip from the printing apparatus after the label strip has been imprinted. While the printing apparatus of the '050 application represents a great advance in the art of printing linerless media, the printing apparatus of the '050 application does require a rotating endless belt for transporting the label strip.

Another apparatus for printing a linerless label strip having an adhesive backing which is not supported by a carrier web is disclosed in copending U.S. application Ser. No. 08/243,198 (hereinafter the "'198 application") to David M. Uland filed on May 16, 1994 and also assigned to the assignee of the present application. The printing apparatus of the '198 application includes a platen roller rotatably mounted to a support frame for supporting and advancing the label strip and a pick for stripping or separating the printed label strip from the platen roller. Thus, a label strip may be fed from a wound roll between a platen roller and an aligned print head such that predetermined indicia are imprinted thereon. Upon further rotation of the platen roller, the leading edge of the label strip engages the pick which acts to release any appreciable adherence between the adhesive backing of the label strip and the platen roller such that the printed labels can extend from and be readily withdrawn from the printing apparatus.

The pick of the printing apparatus of the '198 application generally includes a first edge extending parallel to the axis of the platen roller and typically positioned immediately adjacent to the peripheral surface of the platen roller at a location downstream of the print head. In one embodiment, the first edge is positioned about 90° about the arc of the peripheral surface of the platen roller from the print head. The pick can also include a pick surface extending outwardly from the first edge in a direction away from the platen roller. The pick surface extends generally outwardly from the first edge at an angle of about 30° with respect to a radial line of the platen roller which passes through the first edge. The pick surface can also include a plurality of grooves which extend in a direction away from the platen roller to reduce the surface area of the pick surface which contacts the advancing label strip. The present application is a continuation-in-part of the '198 application, the contents of which are expressly incorporated herein, and is directed to other embodiments of a printing apparatus for printing an adhesive backed label which include means for stripping a leading edge portion of the label strip from the platen roller.

SUMMARY OF THE INVENTION

It is therefore an object of the invention to provide an improved method and apparatus for printing a strip of labels.

It is another object of the invention to provide an improved method and apparatus for printing linerless media having an adhesive backing.

It is a further object of the invention to provide an improved method and apparatus for printing a strip of labels which includes a rotating platen roller for supporting the label strip and an adjacent means for stripping the labels from the platen roller following the printing of indicia on one side thereof.

These and other objects are provided, according to the invention, by a printing apparatus which includes a platen roller, rotatably mounted to a support frame, which supports and advances an adhesive backed label strip past a print head, and means, such as a stripping roller, mounted downstream of the print head and adjacent the platen roller, for stripping a leading edge portion of the label strip from the platen roller following the printing of indicia on one side of the label strip. Thus, a linerless label strip consisting of a primary substrate which is coated on one side with a layer of adhesive, but which is not supported by a carrier web, may be printed by and readily withdrawn from the printing apparatus of the present invention.

The printing apparatus of the present invention also includes means, including the print head, for printing indicia on one side of the label strip. In particular, the print head is positioned in alignment with the platen roller such that the label strip extends between the platen roller and the print head. The printing apparatus also includes means for rotating the platen roller such that the label strip is thereby advanced between the platen roller and the print head. In addition, the printing apparatus includes a holder mounted to the support frame for rotatably supporting a wound roll of the label strip.

In one embodiment, the diameter of the stripping roller is between about 0.090 inches and about 0.20 inches while the diameter of the platen roller is between about 0.250 inches and about 0.625 inches.

The stripping roller is also rotatably mounted to the frame downstream of the print head and adjacent to, and typically spaced apart from, the platen roller. The print head is typically mounted vertically above the platen roller and the uppermost portion of the peripheral surface of the platen roller is typically spaced vertically above the uppermost portion of the peripheral surface of the stripping roller such that the portion of the label strip which is advanced past the platen roller is engaged by the stripping roller.

The platen roller and the stripping roller define a platen roller axis and a stripper roller axis, respectively, extending in parallel relationship through the respective roller. According to one advantageous embodiment, the stripping roller axis is at an elevation approximately midway between the elevation of the platen roller axis and the portion of the peripheral surface of the platen roller which is immediately adjacent the print head.

In one embodiment, the printing apparatus further includes means for rotating the stripping roller such that the adhesive backed label strip is stripped and drawn from the platen roller by the rotating stripping roller. More particularly, the means for rotating the platen roller typically rotates the peripheral surface of the platen roller at a first predetermined rate while the means for rotating the stripping roller rotates the peripheral surface of the stripping roller at a second predetermined rate. Preferably, the second predetermined rate is at least as large as the first predetermined rate that the label strip is drawn from the platen roller.

The printing apparatus also preferably includes a tear bar or cutter positioned downstream of the print head, and above the stripping roller for separating individual labels from the label strip after indicia has been imprinted thereon. In addition, the printing apparatus can include a protective case in which the support frame, holder, platen roller, printing means, platen roller rotating means and stripping means are disposed. The protective case preferably defines a slot through which the printed labels may be withdrawn. Further, the protective case can include a lid portion and a hingedly connected base portion which are adapted to be opened to expose the holder and to facilitate the loading of the wound roll of labels thereon. In one embodiment, the protective case is relatively small such that the printing apparatus is portable and can be readily carried by an operator in the field.

In one embodiment, the platen roller includes an outer peripheral layer of resilient material. Consequently, force exerted by the print head against the underlying platen roller compresses a portion of the outer layer of the platen roller and forms a relatively flat printing surface on the portion of the platen roller contacting the print head. In addition, the peripheral surfaces of both the platen roller and the stripping roller are preferably comprised of a material, such as silicone, which does not appreciably adhere to the adhesive backing of the label strip. Further, the peripheral surface of the stripping roller can also include a plurality of grooves to reduce the surface area of the stripping roller which contacts the advancing label strip.

Accordingly, a strip of linerless labels having an adhesive backing which is not supported by a carrier web may be fed through the printing apparatus of the present invention and indicia may be imprinted thereon. Further, the printing apparatus of the present invention facilitates the stripping or separation of the adhesive backed labels from the rotating platen roller such that the printed labels may be readily withdrawn from the printing apparatus and applied to the appropriate package or container.

The foregoing and other aspects, advantages and features of the invention, and the manner in which the same are accomplished, will become more readily apparent upon consideration of the following detailed description of the invention taken in conjunction with the accompanying drawings, which illustrate preferred and exemplary embodiments, and wherein:

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete and will fully convey the scope of the invention to those skilled in the art. Like numbers refer to like elements throughout.

Figure 1:
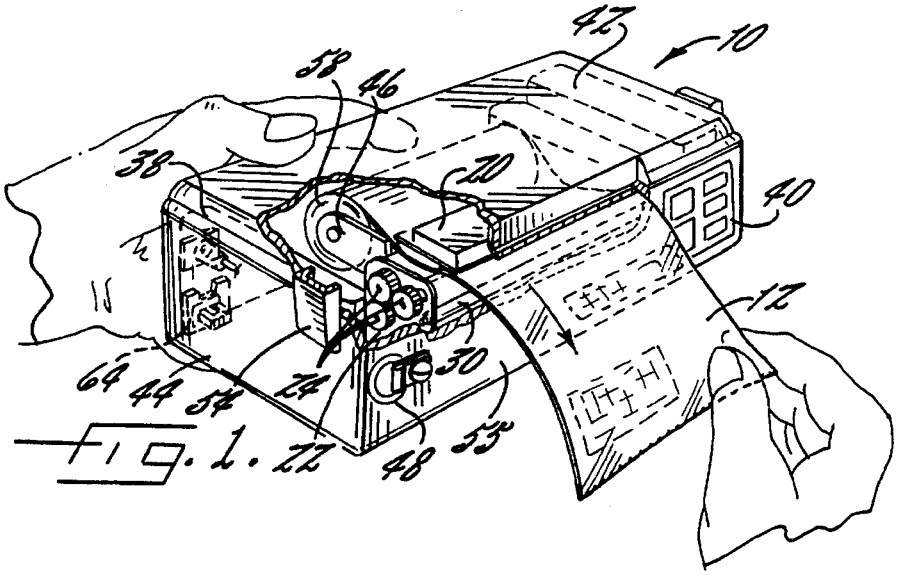
FIG. 1 is a perspective view of a printing apparatus according to the present invention which is partially cutaway to illustrate the internal components thereof.
Figure 2:
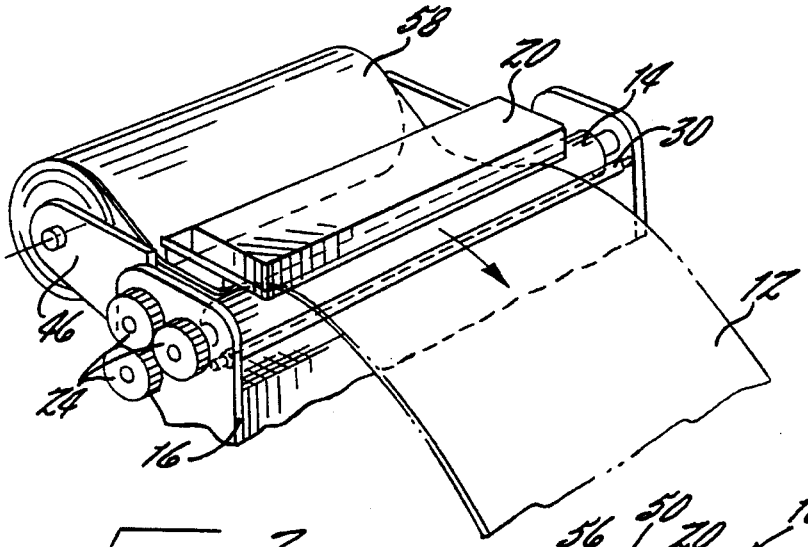
FIG. 2 is a perspective view of a portion of the printing apparatus of the present invention illustrating the relationship of the platen roller and the stripping roller.

Referring now to FIGS. 1 and 2, a printing apparatus 10 according to one embodiment of the present invention is illustrated. The printing apparatus 10 is adapted to print indicia on one side of a strip of adhesive backed labels 12. The printing apparatus 10 includes a platen roller 14 which is rotatably mounted to a support frame 16 and which defines a platen roller axis 18 extending therethrough. As illustrated, the platen roller 14 receives and supports the label strip such that the adhesive backed side of the labels 12 directly contacts the platen roller.

The printing apparatus 10 also includes means for printing indicia on one side of the label strip The printing means includes a print head 20 positioned in alignment with and typically vertically above the platen roller 14 such that the label strip 12 extends horizontally between the platen roller and the print head. The print head 20 can be adapted to print labels 12 according to any of the known methods of printing including serial dot matrix, direct thermal, thermal transfer, laser, line matrix ink jet or impact full form printing as well as other electrographic printing methods. In the embodiment illustrated, the print head 20 is adapted to provide direct thermal printing as is known to those skilled in the art. Thus, in this embodiment, the label strip 12 is thermally sensitive such that appropriate indicia is imprinted thereon by the print head 20.

The printing apparatus 10 also includes means for rotating the platen roller 14 such that the label strip 12 is thereby advanced between the platen roller and the print head 20. As illustrated in FIG. 1, the rotating means can include a drive motor 22 operably connected to the platen roller 14. In particular, the drive motor 22 in the embodiment illustrated is operably connected to a platen roller by several cooperating gears 24. The drive motor 22 can be any suitable motor known to those skilled in the art, such as a servo motor or a stepper motor.

Furthermore, the printing apparatus 10 of the present invention includes means, mounted downstream of the print head 20 and adjacent the platen roller 14, for stripping or separating a portion of the adhesive backed label strip 12, such as the leading edge portion, from the platen roller 14. Once stripped from the platen roller 14, the label strip can be withdrawn from the printing apparatus 10 after indicia has been imprinted thereon, and in the manner further described below.

Figure 3A:
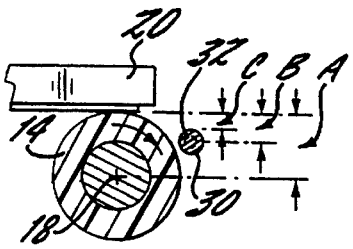
FIG. 3A is a fragmentary lateral cross-sectional view of a portion of the printing apparatus as shown in FIG. 3 illustrating the relative positions of the stripping roller and the platen roller.
Figure 3:
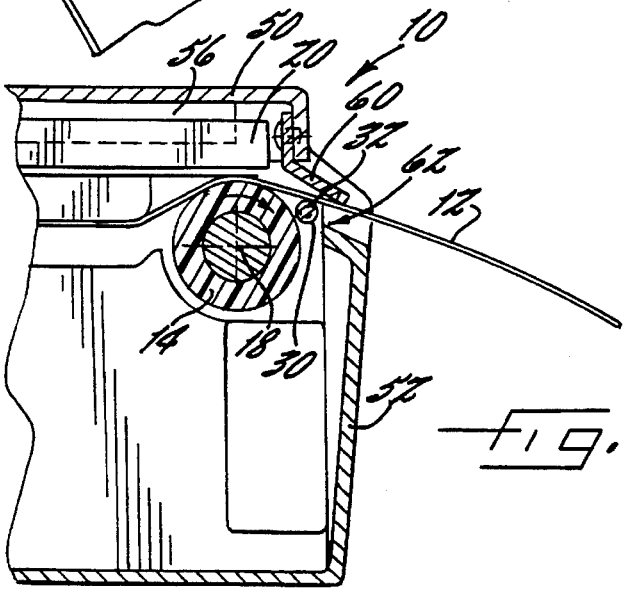
FIG. 3 is a fragmentary lateral cross-sectional view of the printing apparatus of the present invention illustrating in more detail the advancement of the label strip through the printing apparatus.

As illustrated in FIGS. 2 and 3, the stripping means can include a stripping roller 30 rotatably mounted to the support frame 16. While a stripping means which includes a stripping roller 30 is hereinafter described in detail, the stripping means can include other means for stripping or separating a leading edge portion of the adhesive backed label strip 12 from the platen roller 14 without departing from the spirit and scope of the present invention. For example, the stripping means can include the pick described in detail in the copending '198 application.

In the illustrated embodiment, the stripping roller 30 is positioned downstream of the print head 20 and adjacent the platen roller 14. Preferably, the stripping roller 30 is immediately adjacent, but spaced apart from, the platen roller 14. For example, in one embodiment, the platen roller has a diameter of approximately 0.370 inches and the stripping roller has a diameter of 0.090 inches. In this example, the surface of the stripping roller 30 is preferably spaced between about 0.001 inches and about 0.002 inches from the surface of the platen roller 14 and, more preferably, is spaced about 0.0015 inches from the surface of the platen roller. Thus, the label strip 12 can be engaged by the stripping roller 30 and separated from the platen roller 14 as described hereinafter without significant buckling of the label strip. The stripping roller 30 also defines a stripping roller axis 32 extending through the stripping roller. The stripping roller axis 32 is preferably parallel to the platen roller axis 18.

As best illustrated in FIG. 3A in which the print head 20 is mounted vertically above the platen roller 14, the uppermost portion of the peripheral surface of the platen roller 14 can be spaced vertically above the uppermost portion of the peripheral surface of the stripping roller 30 by a vertical displacement C to facilitate stripping of the label strip 12 from the platen roller 14 as described below. In particular, the uppermost portion of the peripheral surface of the platen roller 14 can be spaced up to about 0.200 inches vertically above the uppermost portion of the peripheral surface of the stripping roller 30 and, more preferably, is spaced about 0.020 inches vertically above the uppermost portion of the peripheral surface of the stripping roller. However, the uppermost portion of the peripheral surface of the platen roller 14 can be vertically displaced from the uppermost portion of the peripheral surface of the stripping roller 30 by other amounts without departing from the spirit and scope of the present invention. Further, the uppermost portion of the peripheral surface of the platen roller 14 need not be vertically displaced from the uppermost portion of the peripheral surface of the stripping roller 30. Instead, the respective uppermost portion of the rollers can be at approximately the same height.

In addition, due to the relatively small diameter of the stripping roller 30 in comparison with the diameter of the platen roller 14 as described hereinafter, the stripping roller axis 32 is preferably positioned at an elevation B, as shown in FIG. 3A, which is approximately midway between the elevation A of the platen roller axis 18 and the elevation of the portion of the peripheral surface of the platen roller which is immediately adjacent the print head 20.

As shown in FIG. 3, the leading edge of the adhesive backed label strip 12 typically extends outwardly from the platen roller 14 following separation of the prior label as discussed herein below. The print head 20, however, is biased against the label strip 12 and the underlying platen roller 14. Additional force is commonly exerted by the print head 20 on the label strip 12 and the underlying platen roller 14 during actuation of the print head to imprint indicia on the label strip. Accordingly, the adhesive backing of the label strip 12 is urged against the platen roller 14 and, depending upon the finish of the platen roller and the material forming the platen roller as hereinafter described, can adhere to the platen roller.

This adherence between the adhesive backed label strip 12 and the platen roller 14 tends to draw the printed labels strip downwardly about the platen roller. However, the label strip 12 preferably engages the stripping roller 30 as shown in FIG. 3 which exerts a lifting force on the label strip to separate the label strip from the platen roller 14 as the platen roller continues to rotate. Thus, the stripping of the label strip 12 from the platen roller 14 is facilitated by the positioning of the uppermost portion of the peripheral surface of platen roller vertically above the uppermost portion of the peripheral surface of the stripping roller 30.

Figure 4:
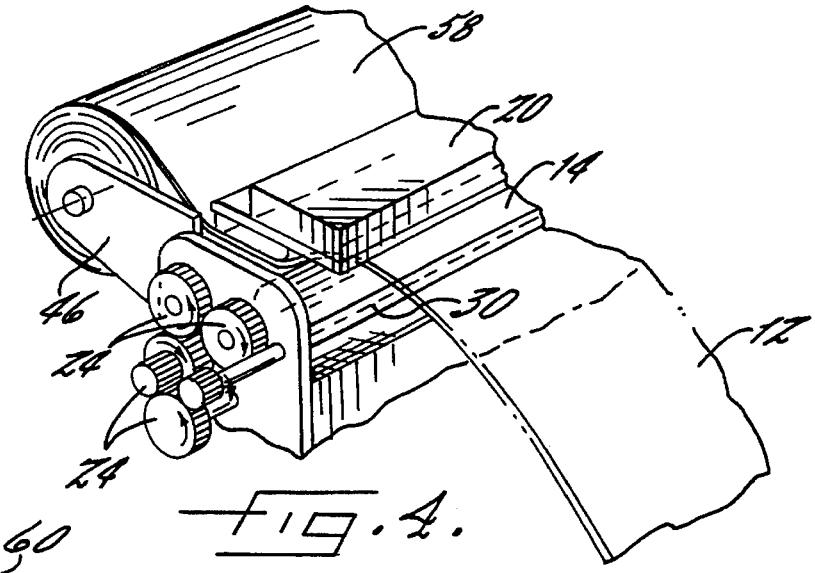
FIG. 4 is a perspective view of a portion of another embodiment of the printing apparatus of the present invention including means for rotating the stripping roller.

In the embodiment of the present invention illustrated in FIG. 4, the printing apparatus be also includes means for rotating the stripping roller 30 such that the adhesive backed label strip 12 is stripped and drawn from the platen roller 14. As illustrated, the means for rotating the stripping roller 30 can include a drive motor 22 operably connected to the stripping roller 30. In particular, the drive motor 22 can rotate both the platen roller 14 and the stripping roller 30 by being operably connected to both the platen roller and a stripping roller by several cooperating gears 24.

The means for rotating the platen roller rotates the peripheral surface of the platen roller 14 at a first predetermined rate while the means for rotating the stripping roller rotates the peripheral surface of the stripping roller 30 at a second predetermined rate. In a preferred embodiment, the second predetermined rate at which the stripping roller 30 is rotated is at least as large or as fast as the first predetermined rate at which the platen roller 14 is rotated. Accordingly, the adhesive backed label strip 12 is stripped and drawn from the platen roller 14. In the illustrated embodiment in which the same drive motor 22 rotates both the platen roller 14 and the stripping roller 30, the arrangement and size of the cooperating gears 24 preferably sets the rates at which the respective rollers rotate.

The diameter of the stripping roller 30 is also preferably smaller than the diameter of the platen roller 14 to further facilitate stripping of the adhesive backed label strip 12 from the rotating platen roller. In one embodiment, the platen roller 14 has a diameter of between about 0.250 inches and about 0.625 inches. A corresponding stripping roller 30 of the present invention preferably has a diameter of between about 0.090 inches and about 0.20 inches and, more preferably, has a diameter of about 0.090 inches. Since the diameter of the stripping roller 30 is relatively small, in comparison to the diameter of the platen roller 30, the adhesive backed label strip 12 does not tend to adhere appreciably to the stripping roller and will, instead, extend across the stripping roller to be readily withdrawn from the printing apparatus 10.

Furthermore, the platen roller 14 of the printing apparatus be of the present invention which includes a stripping roller 30 which does not appreciably adhere to the adhesive backing of the label strip 12 can generally have a larger diameter than the platen roller of a printing apparatus which includes stripping means which appreciably adheres to the adhesive backing of the label strip. Thus, even though a platen roller having a larger diameter will tend to adhere to the adhesive backed label strip more significantly than will a platen roller having a smaller diameter, the printing apparatus 10 of the present invention including a stripping roller 30 facilitates such an increase in the allowable diameter of the platen roller 14 since the stripping roller engages the leading edge of the label strip 12 and draws the strip from the platen roller.

Figure 6:
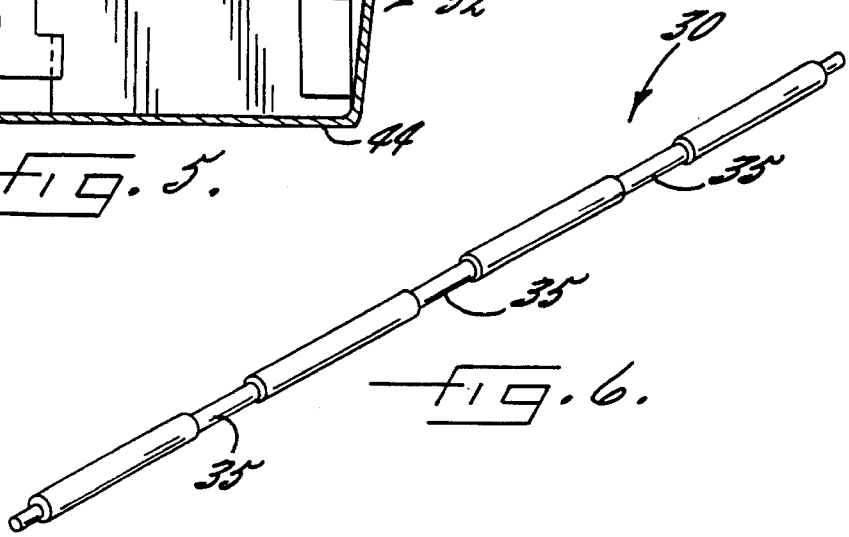
FIG. 6 is a perspective view of a stripping roller illustrating the plurality of grooves defined in the peripheral surface of the stripping roller.

The peripheral surface of the stripping roller 30 is generally planar. However, as illustrated in FIG. 6, one embodiment of the stripping roller 30 includes a plurality of circumferential grooves 35 defined in the peripheral surface of the stripping roller 30. The circumferential grooves 35 extend around the stripping roller 30 so as to be substantially perpendicular to the longitudinal axis of the stripping roller. Thus, the surface area of the stripping roller 30 which contacts the advancing label strip 12 over the stripping roller 30 are reduced and the separation of the label strip from the platen roller 14 is facilitated.

In order to further facilitate the separation of the label strip 12 by the stripping roller 30, at least the peripheral surface of the stripping roller 30 is preferably comprised of a silicone material or a plastic material, such as polytetrafluoroethylene commonly sold under the trademark "Teflon" inches. Thus, the stripping roller 30 will not appreciably adhere to the adhesive backing of the label strip 12.

As described above, the stripping roller 30 separates or strips the label strip 12 from the platen roller 14 even if the label strip has adhered to the platen roller 14 during the printing process. Thus, the platen roller 14 can be comprised of less expensive materials, such as rubber, which may adhere more appreciably to the adhesive backing of the labels 12. However, in some embodiments, the peripheral surface of the platen roller 14 is also comprised of a material, such as silicone, which does not appreciably adhere to the adhesive backing of the label strip 12. Thus, the separation of the label strip 12 from the platen roller 14 by the 30 is improved.

Although not illustrated, the printing apparatus 10 of the present invention, including the platen roller 14 and the adjacent stripping means, can also include an endless belt encircling the platen roller for supporting and advancing the label strip 12 as described in detail in the '050 application. The printing apparatus 10 of the present invention can also be either a stationary printer, which is typically relatively large, or a portable printer, which is readily carried by an operator. For illustrative purposes, however, a portable embodiment of the printing apparatus 10 of the present invention which does not include an endless belt encircling the platen roller 14 is shown and described in more detail herein below.

Since an operator of a portable printing apparatus 10 according to the present invention can readily carry the printing device in the field, the printing device generally includes a battery housing 38 adapted for receiving one or more batteries for supplying the requisite electrical power for printing and advancing the labels 12.

In the field, the operator of such a portable printing device typically transmits data to be printed upon a label, such as via a data interface 64, and the printing apparatus 10 then prints an appropriate label 12. Thereafter, the operator can separate the label 12 and apply the label to the appropriate package or container. The information entered by the operator and imprinted on the label 12 can be stored by the printing apparatus 10 such that, upon returning to the office, the data may be subsequently downloaded, such as to a computer, to update or track inventory, for example. The data may be stored within any suitable memory device 42.

As shown, a portable printing apparatus 10 according to the present invention includes a protective case 44 in which the support frame 16, the holder 46, the platen roller 14, the print head 20, the platen roller rotating means and the stripping roller 30 are disposed. The protective case 44 is relatively small, such as, for example, 8 inches by 5 inches by 3 inches. Thus, the portable printing apparatus 10 can be carried by the operator, such as by a strap draped over the operator's shoulder and attached to the protective case 44 with clips 48.

Figure 5:
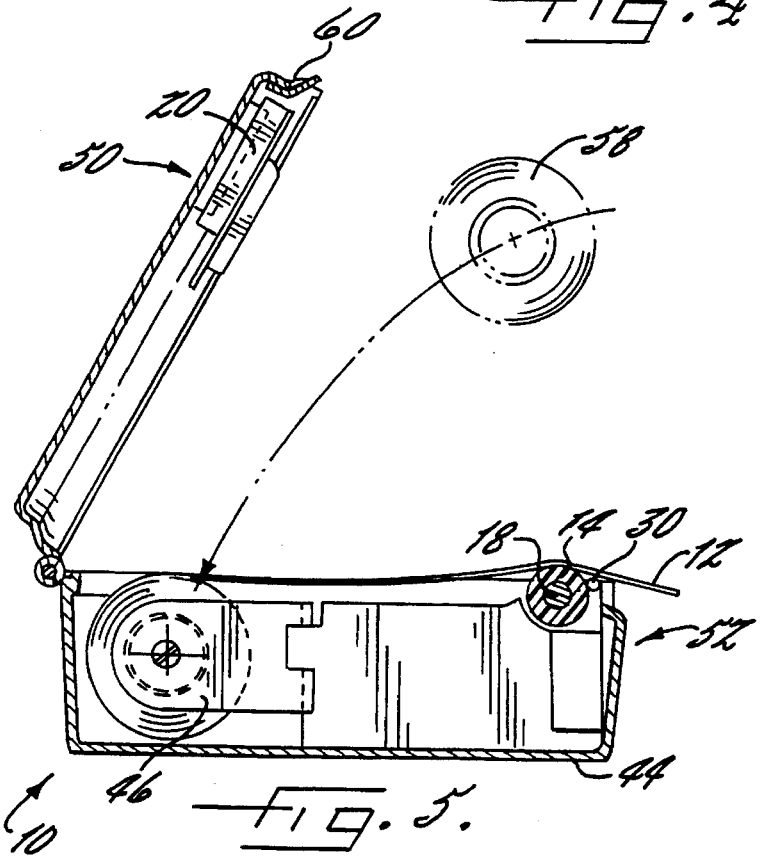
FIG. 5 is a lateral cross-sectional view of the printing apparatus of the present invention in an open position illustrating the loading of a wound roll of labels in the printing apparatus.

In one embodiment, the protective case 44 of the portable printing apparatus 10 of the present invention has a clam shell design. Accordingly, a lid portion 50 of the protective case 44 is hingedly connected to a base portion 52. The lid portion 50 may be raised or opened as illustrated in FIG. 5 during installation of a wound roll of labels 12 or closed as shown in FIG. 1 during printing. A pair of opposed latches 54 may be provided to secure the lid portion 50 in the closed position of FIG. 1.

Furthermore, the protective case 44 defines a slot 62 therein through which labels 12 which have been printed extend prior to separation by the operator. A tear bar 60, as further described below, is mounted along the upper edge of the slot 62. The slot 62 preferably extends substantially parallel to the axis 18 of the platen roller 14.

The drive motor 22, memory device 42, battery housing 38, holder 46 for rotatably mounting a wound roll of labels and print head 20 of the printing apparatus 10 of the invention may be identical to the corresponding components of a conventional portable printer. One example of such a conventional portable printer is Model No. PD 4220 U manufactured by Cognitive Solutions, Inc.

For a printing apparatus adapted to perform direct thermal or thermal transfer printing, the printing apparatus 10 also preferably includes means for biasing the print head 20 against the underlying platen roller 14. The means for biasing the print head 20 maintains printing contact between the print head and the label strip 12 which is advanced between the print head and the platen roller 14. In particular, the biasing means preferably includes one or more springs 56 positioned between the lid portion 50 of the protective case 44 and the print head 20. Accordingly, once the lid portion 50 is closed and latched, the springs 56 will urge the print head 20 against the label strip 12 and the underlying platen roller 14.

In one embodiment, the platen roller 14 includes an outer peripheral layer of resilient material to further enhance the print quality. Thus, the force exerted by the print head 20 against the label strip 12 and the underlying platen roller 14, such as by the biasing means, compresses a portion of the outer layer of the platen roller 14 to form a relatively flat printing surface on the portion of the platen roller 14 contacting the print head 20.

The printing apparatus 10 of the present invention is particularly adapted for printing indicia on labels 12. As illustrated in FIGS. 1 and 2, the labels 12 can be supplied in a wound roll 58. The wound roll 58 is preferably rotatably supported by a holder 46 which, in turn, is mounted to the support frame 16 of the printing apparatus 10.

As illustrated in FIG. 1, the printed labels 12 can be withdrawn from the printing apparatus 10 and separated from adjacent labels by the operator. In particular, the printing apparatus 10 preferably includes a tear bar 60 mounted downstream of the platen roller 14. The tear bar 60 includes a serrated edge against which the operator may pull the label strip 12. Thus, the label strip 12 may be cut so as to separate the printed label from the remainder of the label strip.

During installation of a wound roll 58 of labels, a leading edge portion of the wound roll is drawn from the wound roll and positioned across the platen roller 14 so as to extend outwardly from the platen roller as shown in FIGS. 2 and 3. As explained in relation to the illustrated embodiment, the adhesive backing of the labels 12 directly contacts the underlying platen roller 14 of the illustrated embodiment. Once the lid portion 50 of the protective case 44 is closed, the label strip 12 is held between the print head 20 and the platen roller 14. Thereafter, the print head 20 can be actuated to print indicia on the side of the label strip 12 opposite the adhesive backing. In order to advance or feed the label strip 12, the platen roller 14 is rotated and the label strip is fed between the platen roller and the print head Due to the rotation of the platen roller 14 and the adherence, if any, of the adhesive label backing of the label strip 12 to the platen roller, the label strip tends to rotate with the platen roller and to be drawn downwardly thereabout as described hereinabove.

After loading and throughout the printing process, the label strip 12 preferably passes over and remains in contact with the stripping roller downstream of the platen roller 14. The stripping roller 30 acts to lift the label strip and to thereby release any appreciable adherence between the adhesive backing of the label strip and the platen roller 14 resulting from the printing operation, and so as to cause the strip to be delivered in a tangential direction from the platen roller, note FIG. 3. Even though the stripping roller 30 releases the label strip 12 from the platen roller 14, the stripping roller provides only minimal resistance to the advancement of the label strip in the plane in which the label strip is advancing.

Thus, as illustrated in FIG. 3, the label strip 12 will extend outwardly through the slot 62 defined in the protective case 44. In addition, by controlling the vertical displacement between the uppermost portion of the peripheral surface of the platen roller 14 and the uppermost portion of the peripheral surface of the stripping roller 30, the angle at which the label strip 12 extends through the slot 62 and exits the printing apparatus 10 can be more precisely controlled.

The printed label 12 can then be separated from the remainder of the wound roll 58 of the labels, such as by pulling the label strip against the serrated tear bar 60 as shown in FIG. 1. Once the printed label 12 has been separated, the leading edge portion of the label strip again generally extends tangentially outwardly from the platen roller 14 and over the stripping roller 30 as illustrated in FIGS. 1 and 2 and the printing process can be repeated.

As illustrated in FIG. 1, the label strip 12 typically consists of a primary substrate which has an adhesive backing on one side for attachment to an package or container once the predetermined indicia has been imprinted on the side of the label opposite the adhesive backing. Further, the label strip 12 is characterized in that, unlike conventional label strips, the label strips 12 which the printing apparatus 10 in the present invention is particularly adapted to process are not mounted upon a carrier web. Instead, the side of the label strip 12 opposite the adhesive backing is coated with a release agent, such as silicone. Accordingly, the adhesive will not adhere adjacent label strips together and the label strip 12 may be drawn from the wound roll 58.

In addition to printing label strips, the printing apparatus 10 of the present invention may also print other forms of media, including two-ply and multi-part forms. These forms may also be supplied in a wound roll and may be fed through the printing apparatus 10 such that indicia is imprinted thereon.

The information to be imprinted via the print head 20 may be provided to the printing apparatus 10 of the present invention according to any of the known methods. For example, the information to be imprinted may be provided via a data interface 64 from a source, such as a computer system or a remote alphanumeric keypad, to a system controller. The system controller is operably connected to the print head 20 and transmits signals thereto indicative of the particular indicia to be imprinted and the order and timing of the printing. Alternatively, the information or indicia to be imprinted upon the labels may be entered by the operator via an integral keypad 40 which is operably connected to the print head 20 for providing the control and timing signals necessary to print the desired information on the labels 12. Still further, other methods of providing the printing apparatus with the predetermined information or indicia to be imprinted on the labels 12 are known to those skilled in the art and may be utilized.

The printing apparatus be may also include means for controlling the rotation of the platen roller 14 and the advancement of the label strip 12 between the print head 20 and the platen roller 14 such that the label strip 12 is only advanced once the individual labels which have already been fed between the print head and the platen roller have been separated from the remainder of the label strip. The controlling means therefore prevents a large number of printed labels from accumulating.

The controlling means may include any of the means known to those skilled in the art for controlling the advancement of a media through a printer. For example, the controlling means may include a detector, such as an optical sensor, that detects that the printed labels have been separated from the remainder of the label strip The printing apparatus 10 may also include means for controlling the registry or alignment of the label strip 12 with the print head 20. Thus, for label strips 12 which have been partially preprinted such as with the name of the delivery service, the desired indicia may be printed in the appropriate position relative to the preprinted material on the individual labels. As known to those skilled in the art, the alignment controlling means preferably includes means, such as one or more optical sensors, for detecting the position of the individual labels 12.

As described herein, an adhesive backed label strip 12 may be drawn from a wound roll 58 and fed between a platen roller 14 and a print head 20 such that indicia may be imprinted on one side of the label strip 12. A stripping means, such as a stripping roller 30, thereafter strips or separates the printed labels 12 from the platen roller 14 such that the labels may be separated from the remainder of the label strip and applied to a package or container. Thus, the printing apparatus 10 of the present invention permits printing of label strips 12 which are not mounted upon a carrier web so as to decrease the media cost of the labels. Further, the printing apparatus 10 of the present invention readily separates the label strip 12 from the platen roller 14 after printing.

In the drawings and the specification, there has been set forth preferred embodiments of the invention, and although specific terms are employed, the terms are used in a generic and descriptive sense only and not for purposes of limitation, the scope of the invention being set forth in the following claims.

What is claimed is:

1. An apparatus for printing a linerless label strip backed with a tacky adhesive which is supplied in a wound roll, the printing apparatus comprising:

a support frame;

a holder mounted to said frame for rotatably supporting the wound roll of the label strip;

a platen roller rotatably mounted to said frame for supporting the label strip, said platen roller defining a platen roller axis;

means for printing indicia on one side of the label strip and including a print head positioned in alignment with said platen roller such that the label strip is adapted to extend between said platen roller and said print head;

means for rotating said platen roller such that the label strip is thereby advanced between said platen roller and said print head;

stripping means, mounted downstream of said print head and adjacent said platen roller, for directly contacting the tacky adhesive backing of a portion of the adhesive backed label strip and for providing a lifting force to the label strip to thereby strip a portion of the adhesive backed label strip from said rotating platen roller such that the label strip, having indicia imprinted on one side thereof, can be withdrawn from the printing apparatus, said stripping means comprising a stripping roller rotatably mounted to said support frame, said stripping roller defining a stripping roller axis extending in a parallel relationship to the platen roller axis defined by said platen roller, wherein said print head is mounted vertically above said platen roller, and wherein the uppermost portion of the peripheral surface of said stripping roller is vertically positioned no higher than the uppermost portion of the peripheral surface of said platen roller; and a tear bar for emitting at least one label to be separated from the label strip after indicia has been imprinted thereon, said tear bar being mounted downstream of said stripping roller such that a leasing edge portion of the label strip extends over said stripping roller after the label has been separated from the label strip.

2. The printing apparatus as defined in claim 1 wherein said stripping roller is comprised of a silicone material which does not appreciably adhere to the adhesive backing of the label strip, and wherein said platen roller includes an outer peripheral layer of resilient material such that the force exerted by said print head against said platen roller compresses a portion of the outer layer of said platen roller and forms a relatively flat printing surface on the portion of said platen roller contacting said print head.

3. The printing apparatus as defined in claim 1 wherein said platen roller and said stripping roller define a platen roller axis and a stripping roller axis, respectively, extending in parallel relationship through the respective roller, wherein said print head is mounted vertically above said platen roller, and wherein the stripping roller axis is at an elevation approximately midway between the elevation of the platen roller axis and the elevation of the portion of the peripheral surface of said platen roller which is adjacent said print head.

4. The printing apparatus as defined in claim 1 wherein said stripping roller includes a plurality of grooves defined in the peripheral surface thereof for reducing the surface area of said stripping roller which contacts the advancing label strip.

5. The printing apparatus as defined in claim 1 wherein the diameter of said stripping roller is between about 0.090 inches and about 0.20 inches, and the diameter of said platen roller is between about 0.250 inches and about 0.625 inches.

6. The printing apparatus as defined in claim 1 further comprising means for rotating said stripping roller such that the adhesive backed label strip is stripped from and drawn from said platen roller.

7. The printing apparatus as defined in claim 6 wherein said means for rotating said platen roller rotates a peripheral surface of said platen roller at a first predetermined rate and said means for rotating said stripping roller rotates a peripheral surface of said stripping roller at a second predetermined rate, and wherein the second predetermined rate is at least as large as the first predetermined rate.

8. The printing apparatus as defined in claim 1 wherein the peripheral surface of said platen roller is comprised of a silicone material which does not appreciably adhere to the adhesive backing of the label strip.

9. The printing apparatus as defined in claim 1 further comprising a protective case in which said support frame, said holder, said platen roller, said printing means, said platen roller rotating means and said stripping means are disposed, said protective case defining therein a slot through which the label strip, having indicia imprinted on one side thereof, may be withdrawn, and having a relatively small size so as to be portable such that an operator of the printing apparatus may readily carry the printing apparatus.

10. The printing apparatus as defined in claim 9 wherein said protective case comprises a lid portion and hingedly connected base portion and is adapted to be opened to expose said holder such that the wound roll of labels may be mounted thereon.

11. An apparatus for printing a linerless label strip backed with a tacky adhesive, the apparatus comprising:

a wound roll of a linerless label strip, said label strip comprising a primary substrate, and a layer of tacky adhesive on one side of the primary substrate, and being characterized by the absence of a carrier web;

a support frame;

a holder mounted to said frame for rotatably supporting said wound roll of the label strip;

a platen roller rotatably mounted to said frame for supporting the label strip;

means for printing indicia on one side of the label strip and including a print head positioned in alignment with said platen roller such that the label strip extends between said platen roller and said print head;

means for rotating said platen roller such that the label strip is thereby advanced between said platen roller and said print head;

means comprising a stripping roller, mounted downstream of said print head and adjacent said platen roller, for directly contacting the tacky adhesive backing of the label strip and for providing a lifting force to the label strip to thereby strip the adhesive backed label strip from said platen roller such that the adhesive backed label strip, having indicia imprinted on one side thereof, can be withdrawn from the printing apparatus; and a tear bar for permitting at least one label to be separated from the label strip after indicia has been imprinted thereon, said tear being mounted downstream of said stripping roller such that a leading edge portion of the label strip extends over said stripping roller after the label has been separated from the label strip.

12. The printing apparatus as defined in claim 11 wherein the label strip further comprises a release layer on the side of the substrate opposite the layer of adhesive which does not appreciably adhere to the layer of adhesive so as to facilitate the unwinding of the label strip from said wound roll upon rotation of said platen roller.

13. The printing apparatus as defined in claim 11 wherein said platen roller and said stripping roller define a platen roller axis and a stripping roller axis, respectively, extending in parallel relationship through the respective roller, wherein said print head is mounted vertically above said platen roller, and wherein the uppermost portion of the peripheral surface of said platen roller is spaced vertically above the uppermost portion of the peripheral surface of said stripping roller and the peripheral surface of said stripping roller is spaced apart from the peripheral surface of said platen roller.

14. The printing apparatus as defined in claim 13 wherein said stripping roller is comprised of a silicone or similar material which does not appreciably adhere to the adhesive backing of the label strip, and wherein said platen roller includes an outer peripheral layer of resilient material such that the force exerted by said print head against said platen roller compresses a portion of the outer layer of said platen roller and forms a relatively flat printing surface on the portion of said platen roller contacting said print head.

15. The printing apparatus as defined in claim 11 wherein said platen roller and said stripping roller define a platen roller axis and a stripping roller axis, respectively, extending in parallel relationship through the respective roller, wherein said print head is mounted vertically above said platen roller, and wherein the stripping roller axis is at an elevation approximately midway between the elevation of the platen roller axis and the elevation of the portion of the peripheral surface of said platen roller which is adjacent said print head.

16. The printing apparatus as defined in claim 11 wherein said stripping roller includes a plurality of grooves defined in the peripheral surface thereof for reducing the surface area of said stripping roller which contacts the advancing label strip.

17. The printing apparatus as defined in claim 11 wherein the diameter of said stripping roller is between about 0.090 inches and about 0.20 inches, and the diameter of said platen roller is between about 0.250 inches and about 0.625 inches.

18. The printing apparatus as defined in claim 11 further comprising means for rotating said stripping roller such that the adhesive backed label strip is stripped from and drawn from said platen roller.

19. The printing apparatus as defined in claim 18 wherein said means for rotating said platen roller rotates a peripheral surface of said platen roller at a first predetermined rate and said means for rotating said stripping roller rotates a peripheral surface of said stripping roller at a second predetermined rate, and wherein the second predetermined rate is at least as large as the first predetermined rate.

20. A method for printing a strip of labels comprising the steps of:

providing a wound roll of a linerless label strip, the label strip being backed with a tacky adhesive;

providing a printing apparatus having a platen roller, an aligned print head, a stripping roller for stripping a portion of the adhesive backed label strip from the platen roller and a tear bar mounted downstream of the stripping roller;

drawing the label strip from the wound roll to the platen roller;

actuating the print head to print indicia on the side of the label strip opposite the adhesive backing;

rotating the platen roller such that the label strip is fed between the platen roller and the print head;

directly contacting the tacky adhesive backing of a portion of the label strip and lifting the contacted portion of the label strip with the stripping roller such that further rotation of the platen roller releases any significant adherence between the tacky adhesive backing of the label strip and the platen roller and so as to cause the strip to be delivered in a tangential direction from the platen roller; and separating at least one label from the label strip after indicia has been imprinted thereon by urging a portion of the label strip against the tear bear such that the leading edge portion of the label strip remaining following said separating step extends tangentially outward from the platen roller and over the stripping roller to permit a repeating of the steps of the method to print another label.

21. The method as defined in claim 20 wherein a peripheral surface of the platen roller is rotated at a first predetermined rate, the method further comprising a step of rotating a peripheral surface of the stripping roller at a second predetermined rate which is at least as large as the first predetermined rate at which the platen roller is rotated such that the label strip is stripped and drawn from the platen roller.

* * * * *

UNITED STATES PATENT AND TRADEMARK OFFICE

CERTIFICATE OF CORRECTION

PATENT NO. : 5,487,337

DATED : January 30, 1996

INVENTOR(S) : David M. Uland

It is certified that error appears in the above-indentified patent and that said Letters Patent is hereby corrected as shown below:

On the cover page, under [56] References Cited, insert the following references:

| | | | |
|---|---|---|---|
| -- | 0637 547A1 | 2/1995 | Europe |
| | 29 07 445 | 1/1980 | Germany |
| | 0416 802A1 | 3/1991 | Europe |

International Search Report mailed 7/27/95 for PCT/US95/05995 --

Column 6, line 18, after "strip" insert -- 12. --.

Column 7, line 56, "labels" should be -- label --.

Column 7, line 67, "be" should be -- 10 --.

Column 8, line 40, "be" should be -- 10 --.

Column 9, line 3, omit "inches".

Column 9, line 16, before "30" insert -- stripping roller --.

Column 10, line 64, after "head" insert -- 20. --.

Column 11, line 5, after "roller" insert -- 30, --

UNITED STATES PATENT AND TRADEMARK OFFICE

CERTIFICATE OF CORRECTION

PATENT NO. : 5,487,337

DATED : January 30, 1996

INVENTOR(S) : David M. Uland

It is certified that error appears in the above-indentified patent and that said Letters Patent is hereby corrected as shown below:

Column 11, line 35, "an" should be -- a --.

Column 11, line 67, after "apparatus" insert -- 10 --.

Column 12, line 3, "be" should be -- 10 --.

Column 12, line 17, after "strip" insert -- 12. --.

Column 12, line 42, "has" should be -- have --.

Column 13, line 17, "emitting" should be -- permitting --.

Column 13, line 20, "leasing" should be -- leading --.

Column 14, line 43, after "tear" insert -- bar --.

Column 16, line 23, "bear" should be -- bar --.

Signed and Sealed this

Ninth Day of July, 1996

Bruce Lehman

*Attest:*

BRUCE LEHMAN

*Attesting Officer*

*Commissioner of Patents and Trademarks*